US012203374B1

(12) United States Patent
Yin et al.

(10) Patent No.: US 12,203,374 B1
(45) Date of Patent: Jan. 21, 2025

(54) SYSTEM FOR MONITORING OVERLYING ROOF ROCK AND COAL PILLAR OF GOB-SIDE ENTRY AND METHOD THEREOF

(71) Applicants: SHANDONG UNIVERSITY OF SCIENCE AND TECHNOLOGY, Qingdao (CN); Shandong Energy Group Co., Ltd, Jinan (CN)

(72) Inventors: Yanchun Yin, Qingdao (CN); Tongbin Zhao, Qingdao (CN); Xiufeng Zhang, Qingdao (CN); Yang Chen, Qingdao (CN); Xingyin Ma, Qingdao (CN); Xinrong Zhang, Qingdao (CN); Cao Man, Qingdao (CN); Zhenlei Zhu, Qingdao (CN)

( * ) Notice: Subject to any disclaimer, the term of this patent is extended or adjusted under 35 U.S.C. 154(b) by 0 days.

(21) Appl. No.: 18/818,624

(22) Filed: Aug. 29, 2024

Related U.S. Application Data

(63) Continuation of application No. PCT/CN2023/138264, filed on Dec. 12, 2023.

(30) Foreign Application Priority Data

Sep. 19, 2023 (CN) ..... 202311211499.6

(51) Int. Cl.
*E21F 17/18* (2006.01)
*E21C 41/16* (2006.01)

(52) U.S. Cl.
CPC ..... *E21F 17/185* (2013.01); *E21C 41/16* (2013.01)

(58) Field of Classification Search
CPC ..... E21F 17/185
(Continued)

(56) References Cited

U.S. PATENT DOCUMENTS 3,828,435 A * 8/1974 Baker ..... E21F 17/185 33/700
4,093,310 A * 6/1978 Terry ..... E21B 43/305 166/292

(Continued)

OTHER PUBLICATIONS

Internation Search Report of CT/CN2023/138264 Mailed Jun. 5, 2024.
Grant notice of CN202311211499.6, Mailed May 30, 2024.

*Primary Examiner* — George B Bennett
(74) *Attorney, Agent, or Firm* — Xia Li

(57) ABSTRACT

A system and a method for monitoring overlying roof rock and coal pillar in gob-side entry are provided. The system includes top monitoring stations, coal pillar comprehensive monitoring stations, roof stress monitoring stations, and a master computer. Top monitoring stations are arranged in the crossheading to monitor the working face, coal pillar comprehensive monitoring stations are arranged in the upper roadway of the lower coal seam working face to monitor the coal pillars, and roof stress monitoring stations are arranged in the mining area main roadway to monitor the coal pillars. Monitoring the stress and deformation distribution of coal pillars in the goaf and the movement and failure process of overburden strata structure through the master computer control each monitoring station. The monitoring stations ensure that the overburden strata movement monitoring stations are still in working condition after the goaf is formed by mining in the working face.

6 Claims, 5 Drawing Sheets

(58) Field of Classification Search
USPC ..... 33/1 H
See application file for complete search history.

(56) References Cited

U.S. PATENT DOCUMENTS

| | | | | | |
|---|---|---|---|---|---|
| 4,448,252 | A * | 5/1984 | Stoddard | E21B 33/138 | 166/402 |
| 4,693,638 | A * | 9/1987 | Unrug | E21D 21/0093 | 405/259.1 |
| 5,791,058 | A * | 8/1998 | Seifert | G01M 5/0033 | 33/1 HH |
| 6,666,521 | B1 * | 12/2003 | Pease | E21C 27/24 | 299/1.1 |
| 9,739,148 | B2 * | 8/2017 | Siegrist | E21F 17/185 | |
| 10,364,676 | B2 * | 7/2019 | Knuth | E21D 23/26 | |
| 10,502,863 | B2 * | 12/2019 | Mosse | G01V 11/00 | |
| 11,299,954 | B2 * | 4/2022 | Huang | E21B 4/02 | |
| 11,414,991 | B2 * | 8/2022 | Zhang | E21F 17/185 | |
| 11,834,949 | B2 * | 12/2023 | Guo | E21C 41/18 | |
| 2023/0296020 | A1 * | 9/2023 | Zhang | G01V 11/002 | 299/1.05 |

* cited by examiner

SYSTEM FOR MONITORING OVERLYING ROOF ROCK AND COAL PILLAR OF GOB-SIDE ENTRY AND METHOD THEREOF

CROSS-REFERENCE TO RELATED APPLICATIONS

This application is a continuation of International Application No. PCT/CN2023/138264 with a filling date of Dec. 12, 2023, designating the United states, now pending, and further claims to the benefit of priority from Chinese Application No. 202311211499.6 with a filing date of Sep. 19, 2023. The content of the aforementioned applications, including any intervening amendments thereto, are incorporated herein by reference.

TECHNICAL FIELD

The present disclosure relates to the technical field of mine pressure monitoring, in particular to a system for monitoring overlying roof rock and coal pillar of gob-side entry and a method thereof.

BACKGROUND

About 90% of the rock burst in deep mine occurs in tunnels, among which the gob-side entry is an area where rock burst is easy to occur, frequent and difficult to prevent. In order to reduce stress concentration in coal pillar, coal pillar is generally provided between the goaf and the gob-side entry. Due to the low bearing capacity of coal pillar, the deformation and rupture of coal pillar is relatively severe under overburden pressure. At the same time, the support pressure of the coal beside support increases, and the risk of rock burst increases. The overburden strata on the goaf side of the gob-side entry is generally not fully mined, and due to the influence of mining activities of adjacent working face, the overburden strata on the goaf side will move again. Under the action of unstable overburden strata near the goaf side movement, the rock burst risk of coal pillar is instability. Therefore, accurately obtainment of the structure and movement law of the overburden strata on the goaf side of the gob-side entry, as well as the deformation law of the coal pillar under stress, is the key to monitoring, warning, and controlling the risk the rock burst of the gob-side entry.

The existing monitoring scheme mainly focuses on monitoring borehole stress, value of drilling cuttings weight, tunnel deformation, microseism, ground noise, support resistance, CT monitoring, roof abscission layer, and drilling peep in the tunnels or working face. The type of monitoring scheme mainly focuses on the characteristics of strata behavior of tunnels during mining in the working face, without considering the influence of adjacent working face driving or stopping, and cannot monitor and obtain the movement law of overburden strata in the goaf, there is no effective monitoring method suitable for coal pillar stress and deformation, and it cannot be used for dynamic monitoring the structure movement of overburden strata on the goaf side of the gob-side entry and coal pillar stress and deformation.

SUMMARY

The present disclosure provides a monitoring system and a method for overlying roof rock and coal pillar in gob-side entry to avoid the disadvantages of the existing monitoring scheme. The system and the method can monitor and analyze the movement of overburden strata structure of the goaf side and the stress distribution data of the coal pillar deformation during the entire process of the gob-side entry driving and working face mining, providing data support for the analysis of the stability of the coal pillar and the failure mode of the overlying roof rock structure.

To achieve the above objectives, the present disclosure provides the following technical solution:

A system for monitoring overlying roof rock and coal pillar of gob-side entry, including top monitoring stations, coal pillar comprehensive monitoring stations, roof stress monitoring stations, and a master computer;

- a first working face is arranged on a lower coal seam, coal pillars are arranged on a first working face upper roadway, and a plurality of the coal pillar comprehensive monitoring stations on the coal pillars;
- an upper coal seam is located above the lower coal seam, a third working face is arranged on the upper coal seam, a plurality of crossheadings are arranged on the third working face, and a plurality of the top monitoring stations are arranged on the crossheadings;
- a plurality of roof stress monitoring stations are arranged at roofs of the coal pillars between the first working face and the second working face on a mining area main roadway; and
- the master computer is respectively connected to the control terminals of the top monitoring stations, the coal pillar comprehensive monitoring stations, and the roof stress monitoring stations through signal cables, during the mining period of the first working face, the top monitoring stations, the coal pillar comprehensive monitoring stations, and the roof stress monitoring stations continuously monitor the overlying roof rock and the coal pillar in a goaf of the first working face.

Compared with the prior art, the present disclosure has the following advantageous effects:

The system can monitor the stress and deformation distribution of coal pillar and the failure process of overburden strata structure movement in the goaf of the working face (first working face) during the mining of the working face (first working face). At the same time, it further can achieves the monitoring of the stress and deformation distribution of coal pillar and the failure process of overburden strata structure movement in the goaf of the working face (first working face) during the excavation or mining period of the working face (second working face) adjacent to the working face (first working face).

According to the disclosure, various monitoring stations are arranged in the crossheading of the upper coal seam and the roadway of the lower coal seam working face, which can ensure to the maximum extent that the overburden strata movement monitoring stations are still in working condition after the goaf is formed by mining in the working face, and will not fail due to the formation of the goaf.

The construction of the borehole used in the present disclosure is carried out in the roadway, which can reduce monitoring safety risks and provide data support for coal pillar stability analysis and overlying roof rock movement calculation.

REFERENCE NUMBERS IN THE DRAWINGS

Figure 1:
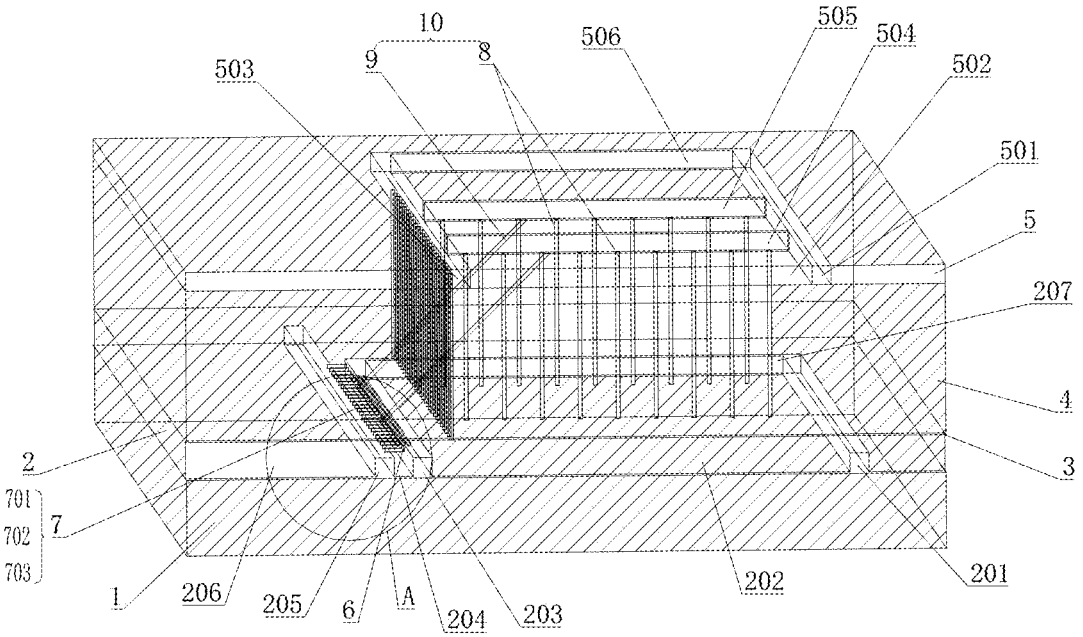
FIG. 1 is a first schematic diagram of a system for monitoring overlying roof rock and coal pillar of gob-side entry in an embodiment of the present disclosure.

1—floor, 2—lower coal seam, 201—first working face lower roadway, 202—first working face, 203—first working face upper roadway, 204—coal pillar, 205—second working face lower roadway, 206—second working face, 207—first working face open—off cut, 3—mining area main roadway, 4—roof, 5—upper coal seam, 501—third working face lower roadway, 502—third working face, 503—third working face upper roadway, 504—first crossheading, 505—second crossheading, 506—third working face open—off cut, 6—roof stress monitoring station, 7—coal pillar comprehensive monitoring station, 701—coal pillar stress monitoring station, 702—coal pillar internal horizontal displacement monitoring station, 703—coal pillar internal vertical deformation monitoring station, 8—roof abscission layer monitoring station, 9—overburden strata movement trajectory monitoring station, 10—top monitoring station.

DETAILED DESCRIPTION OF THE EMBODIMENTS

The present invention will be further described with reference to the drawings and preferred embodiments. It should be understood that these embodiments are only used to illustrate the present invention, but the present invention is not limited thereto. In addition, it should be understood that after reading the content described in the present invention, those skilled in the art can make various changes or modifications to the present invention, and these equivalent technical means also fall within the scope of protection of the present invention.

In the present invention, the terms "first," "second," and "third" are merely for the purpose of description, but cannot be understood as indicating or implying relative importance.

In the description of the present invention, it should be understood that if orientation or position relations indicated by the terms such as "upper," "lower," "left," "right," "front," "back," and the like are based on the orientation or position relations shown in the drawings, and the terms are intended only to facilitate the description of the present invention and simplify the description, rather than indicating or implying that the apparatus or element referred to must have a particular orientation and be constructed and operated in the particular orientation, and therefore cannot be construed as a limitation on the present invention.

The present disclosure provides a system for monitoring the movement of overburden strata structure and the deformation of coal pillar in gob-side entry. The system utilizes various monitoring stations to continuously monitor the coal pillar and overburden strata structure movement on the goaf side during the mining of the working face, the excavation or mining of adjacent gob-side entry of the working face to obtain the stress and deformation distribution of the coal pillar and the movement and failure laws of overlying roof rock structure at different mining stages.

Figure 2:
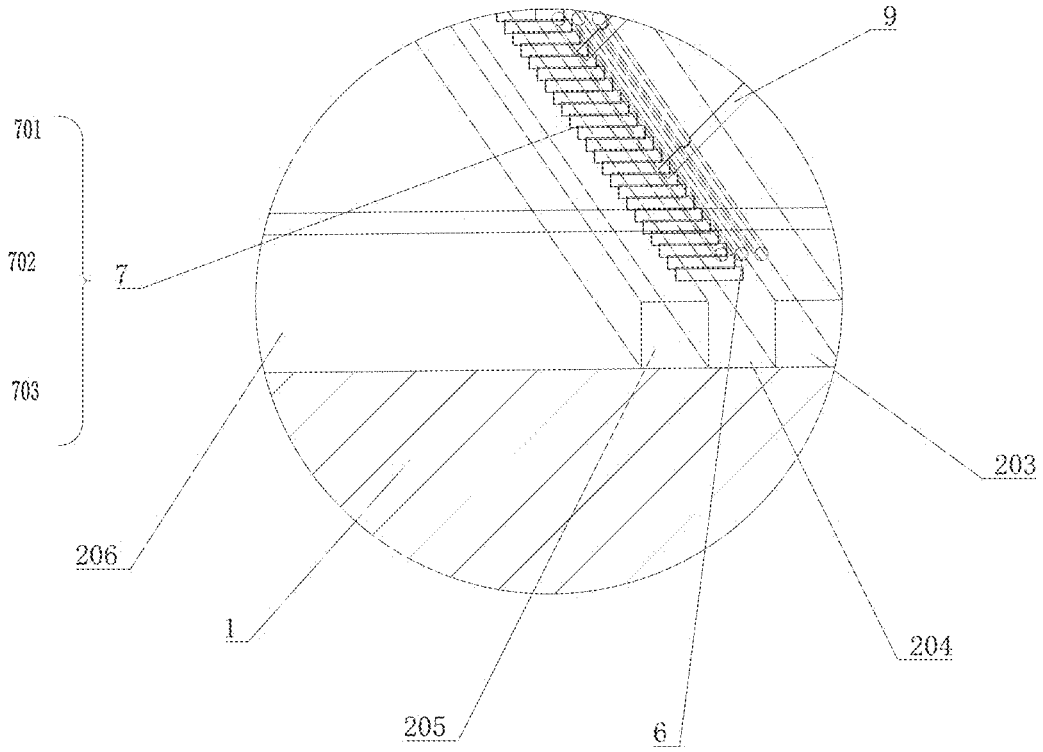
FIG. 2 is an enlarged partial view of part A in FIG. 1.
Figure 3:
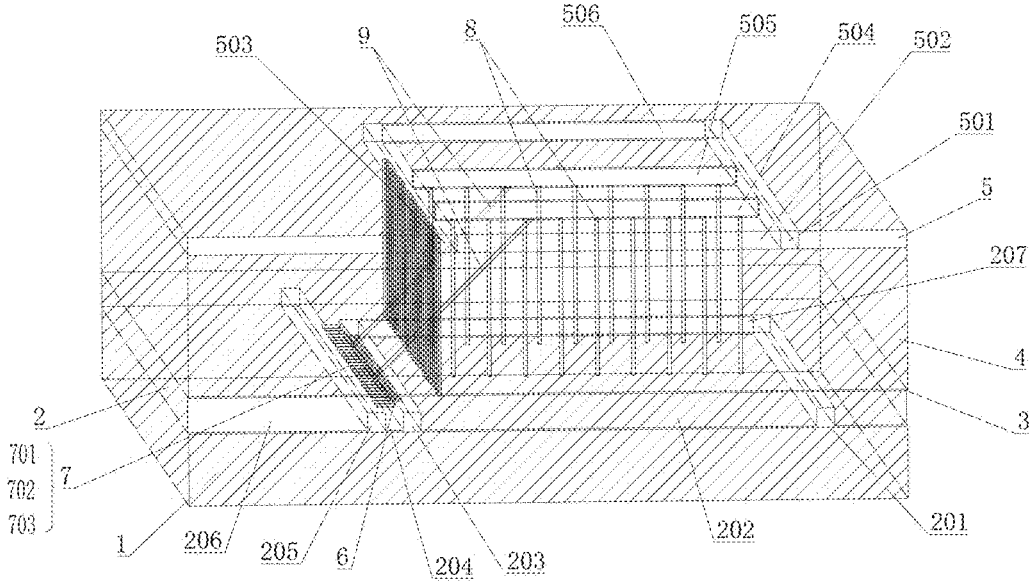
FIG. 3 is a second schematic diagram of the system for monitoring overlying roof rock and coal pillar of gob-side entry in the embodiment of the present disclosure.
Figure 4:
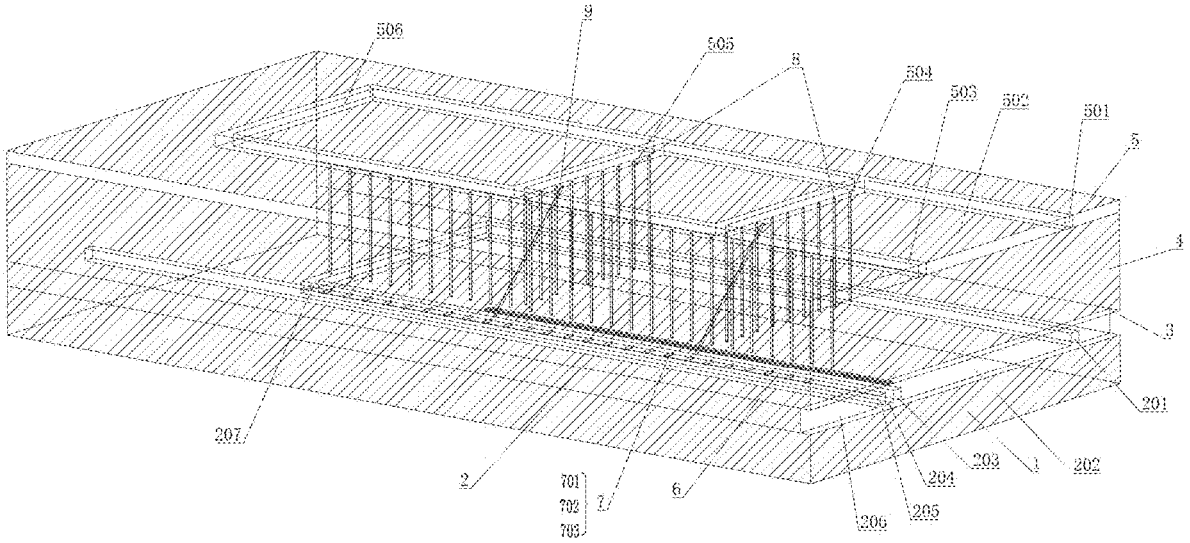
FIG. 4 is a third schematic diagram of the system for monitoring overlying roof rock and coal pillar of gob-side entry in the embodiment of the present disclosure.
Figure 5:
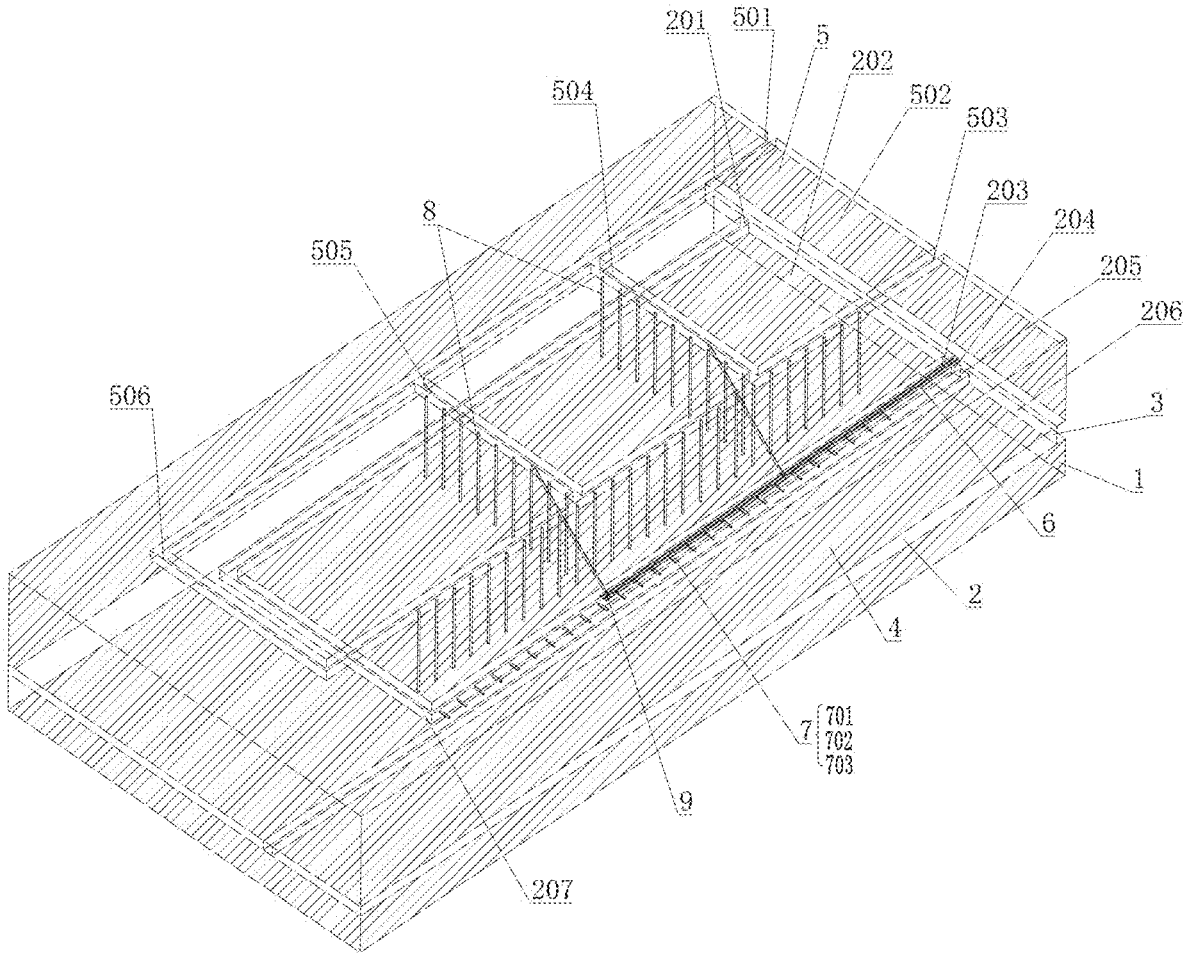
FIG. 5 is a fourth schematic diagram of the system for monitoring overlying roof rock and coal pillar of gob-side entry in the embodiment of the present disclosure.
Figure 6:
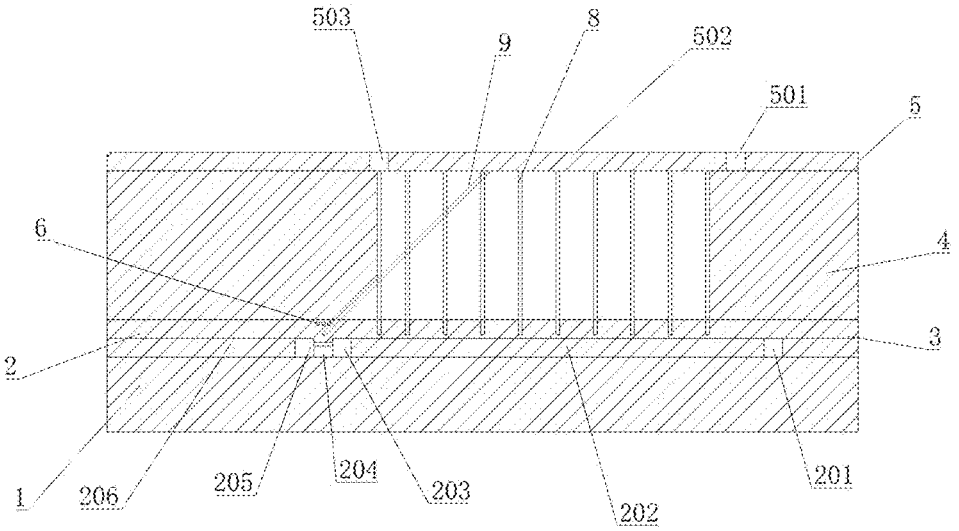
FIG. 6 is a front view of the system for monitoring overlying roof rock and coal pillar of gob-side entry in the embodiment of the present disclosure.
Figure 7:
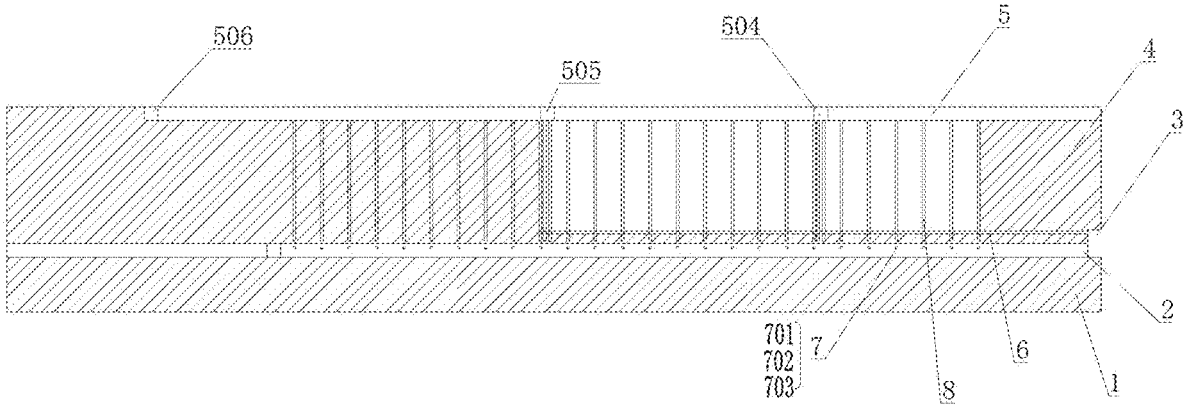
FIG. 7 is a side view of the system for monitoring overlying roof rock and coal pillar of gob-side entry in the embodiment of the present disclosure.
Figure 8:
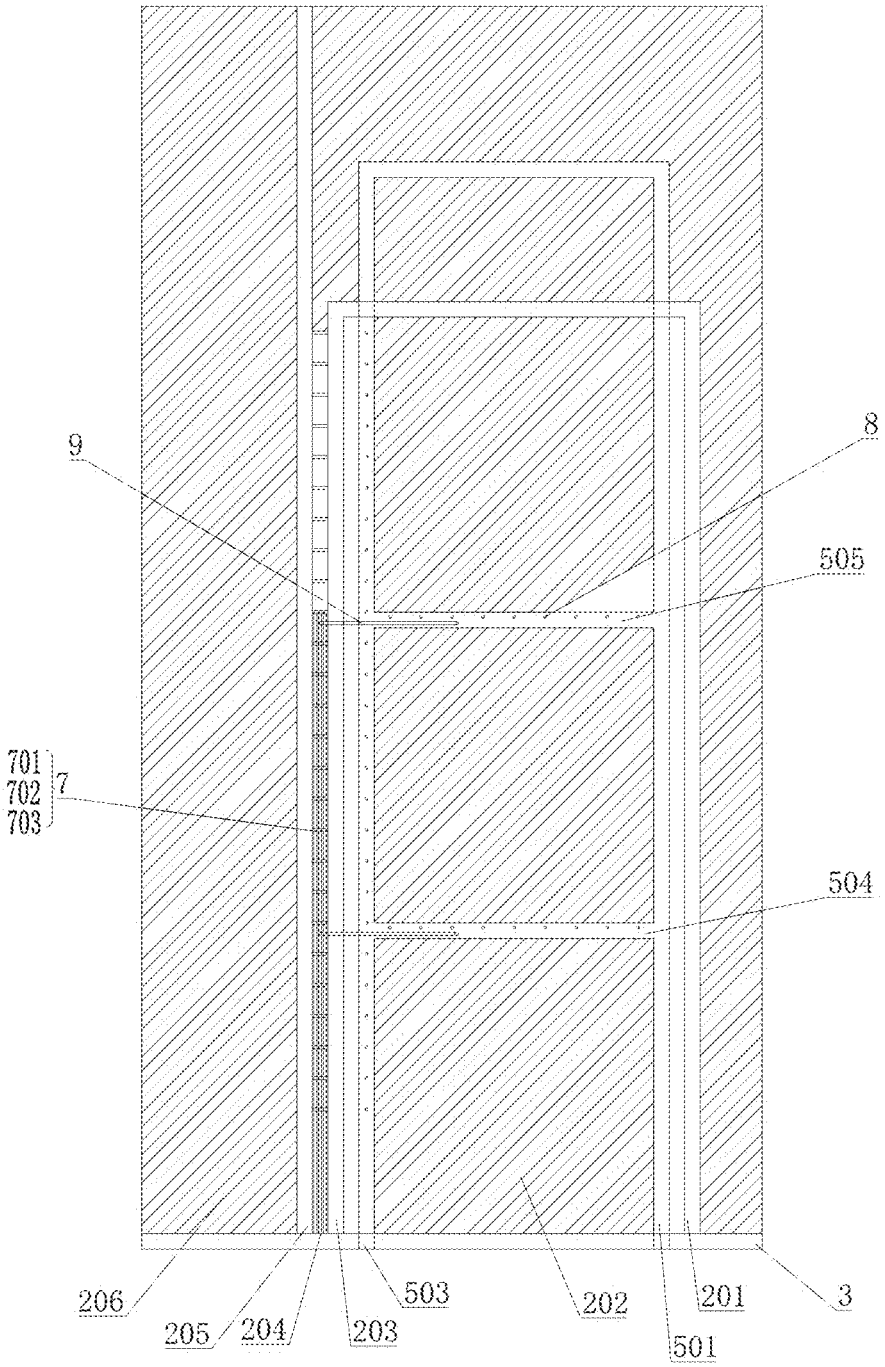
FIG. 8 is a top view of the system for monitoring overlying roof rock and coal pillar of gob-side entry in the embodiment of the present disclosure.

Please refer to FIG. 1-FIG. 8. In this embodiment, the system for monitoring overlying roof rock and coal pillar of gob-side entry includes top monitoring stations 10, coal pillar comprehensive monitoring stations 7, roof stress monitoring stations 6, and a master computer.

In the process of coal mining, the coal mine can be divided into the mining of an upper coal seam 5 and the mining of a lower coal seam 2. The lower coal seam 2 is located below the upper coal seam 5, and the lower coal seam 2 is located above the floor 1. In the system, the first working face 202 is arranged on the lower coal seam 2, and the first working face upper roadway 203 and the first working face lower roadway 201 are arranged on both sides of the first working face. The coal pillar 204 is arranged on the first working face upper roadway 203. A second working face 206 is arranged on one side of the first working face upper roadway 203 in the lower coal seam 2, and the coal pillar 204 is located between the first working face upper roadway 203 and the second working face lower roadway 205.

The third working face 502 is arranged on the upper coal seam 5, and the excavation of the third working face upper roadway 503 and the third working face lower roadway 501 of the upper coal seam 5 is completed before mining the first working face 202 of the lower coal seam 2. After setting the distance for excavation, a plurality of crossheadings are arranged along the direction perpendicular (or inclined) to the third working face upper roadway 503 of the upper coal seam 5. (in the system, taking two crossheadings as an example, the first crossheading 504 and the second crossheading 505 are arranged).

In the system, the third working face upper roadway 503 of the upper coal seam 5 is located diagonally above the first working face upper roadway 203 of the lower coal seam 2, and the length of the third working face 502 of the upper coal seam 5 is smaller than the length of the first working face 202 of the lower coal seam 2.

A third working face open-off cut 506 is arranged at a set distance on the upper coal seam 5, and mining is started from the third working face open-off cut 506 of the third working face 502. The first working face open-off cut 207 is arranged at a set distance on the lower coal seam 2, and mining is started from the first working face open-off cut 207 of the first working face 202.

In the system, a plurality of coal pillar comprehensive monitoring stations 7 are arranged on the coal pillar 204 to monitor the stress distribution pattern and evolution data, horizontal displacement and compression deformation data of the coal pillar 204, so as to determine the range of plastic zone, the position of elastic core zone, and the internal crack positions and expansion evolution law in the coal pillar 204.

A plurality of top monitoring stations 10 are arranged on the floor of the crossheading. The top monitoring station is used to monitor the movement and fracture data of the overburden strata in the goaf of the first working face 202, so as to determine the position of the fracture layer, the length of the fracture block, and the range of the three-zones (caving zone, fractured zone, and sagging subsidence zone) of the overburden strata; the top monitoring station is used to monitor the movement trajectory of the overburden strata to determine the rotation angle and rotational speed of each rock stratum after fracture, and further determine the loading mode of overburden strata structure movement on coal pillar.

A plurality of roof stress monitoring stations 6 are arranged on the roof 4 of the first working face upper roadway 203 of the mining area main roadway 3. The roof stress monitoring station 6 is used to monitor the stress distribution and evolution data of the roof 4, so as to determine the loading mode of overburden strata structure movement on the coal pillar.

In the system, the master computer is respectively connected to the control terminals of the top monitoring stations 10, the coal pillar comprehensive monitoring stations, and the roof stress monitoring stations 6 through signal cables. During the mining of the first working face 202, the top monitoring stations 10, the coal pillar comprehensive monitoring stations 7, and the roof stress monitoring stations 6 continuously monitor the overburden strata and the coal pillar of the roof 4 in the goaf of the first working face 202.

In the system, a plurality of top monitoring stations 10 are arranged at the bottoms of the first crossheading 504 and the second crossheading 505. The top monitoring station includes a roof abscission layer monitoring station 8 and an overburden strata movement trajectory monitoring station 9.

A plurality of roof abscission layer monitoring stations 8 are arranged on the floors of the first crossheading 504 and the second crossheading 505. Each roof abscission layer monitoring station 8 is provided with a multi-point displacement meter. The installation borehole of the multi-point displacement meter is drilled from the floors of both the first crossheading 504 and the second crossheading 505 towards the first working face 202, and the depth of borehole reaches the immediate roof of the first working face 202. The first base point anchor of the multi-point displacement meter is installed in the immediate roof strata of the first working face 202, so that the sensor of the multi-point displacement meter is located in the immediate roof strata of the first working face 202.

A plurality of overburden strata movement trajectory monitoring stations 9 are arranged at the bottom of the first crossheading 504 and the second crossheading 505. Each overburden strata movement trajectory monitoring station 9 is provided with a shape acceleration array. The installation borehole of the shape acceleration array is drilled from the floor of both the first crossheading 504 and the second crossheading 505 towards the coal pillar 204 between the first working faces 202 and the second working faces 206. The depth of the borehole should reach the immediate roof strata of the first working face 202. The first section of the shape acceleration array of the roof abscission layer monitoring station 8 is installed in the immediate roof strata of the first working face 202, so that the sensor of the shape acceleration array is located in the immediate roof strata of the first working face 202.

A plurality of coal pillar comprehensive monitoring stations 7 are arranged on the coal pillar 204 of the first working face upper roadway 203, and the coal pillar comprehensive monitoring stations 7 are arranged at intervals along the coal pillar 204. In the system, the coal pillar comprehensive monitoring station 7 includes a coal pillar stress monitoring station 701, a coal pillar internal horizontal displacement monitoring station 702 and a coal pillar internal vertical deformation monitoring station 703.

A plurality of coal pillar stress monitoring stations 701 are arranged on the coal pillar 204. Each coal pillar stress monitoring station 701 is provided with an one-hole multi-point borehole stressmeter. The installation hole of each one-hole multi-point borehole stressmeter is arranged inside the coal pillar 204, and the depth of the installation hole should be smaller than the width of the coal pillar 204, so that the sensor of the one-hole multi-point borehole stressmeter is located inside the coal pillar 204.

A plurality of coal pillar internal horizontal displacement monitoring stations 702 are arranged on the coal pillar 204. Each coal pillar internal horizontal displacement monitoring station 702 is provided with a multi-point displacement meter. The installation hole of each multi-point displacement meter is arranged inside the coal pillar 204, and the depth of the installation hole should be less than the width of the coal pillar 204, so that the sensor of the multi-point displacement meter is located inside the coal pillar 204.

A plurality of coal pillar internal vertical deformation monitoring stations 703 are arranged on the coal pillar 204. Each coal pillar internal vertical deformation monitoring station 703 is provided with a shape acceleration array. The installation hole of each shape acceleration array is arranged inside the coal pillar 204, and the depth of the installation hole should be less than the width of the coal pillar 204, so that the sensor of the shape acceleration array is located inside the coal pillar 204.

A plurality of roof stress monitoring stations 6 are arranged at the roof 4 of the coal pillar 204 between the first working face 202 and the second working face 206 in the mining area main roadway 3. In the system, each roof stress monitoring station 6 is provided with an one-hole multi-point borehole stressmeter. The installation hole of the one-hole multi-point borehole stressmeter is drilled from the mining area main roadway 3 to the roof 4 of the lower coal seam above the coal pillar 204. After the installation hole is drilled to the main roof, a plurality of one-hole multi-point borehole stressmeters are arranged in parallel to the direction of the arrangement of the coal pillar 204.

In the system, first, the mining of the first working face 202 is carried out, followed by the excavation of the second working face 206 (excavation of second working face lower roadway 205), finally, the mining of the second working face 206 is carried out. The above stations can continuously monitor the stress and deformation distribution of coal pillar and the movement and failure process of the overburden strata structure of the roof 4 in the goaf (on the goaf side of the gob-side entry) of the first working face 202 during the mining of the first working face 202, the excavation of the second working face 206, or the mining of the second working face 206.

On the basis of the above-mentioned system for monitoring overlying roof rock and coal pillar of gob-side entry, the present disclosure further provides a method for monitoring overlying roof rock and coal pillar in gob-side entry. The steps of the method are as follows:

Step 1: a roof abscission layer monitoring station 8 and an overburden strata movement trajectory monitoring station 9 are arranged on the floor of the crossheading, a coal pillar stress monitoring station 701, a coal pillar internal horizontal displacement monitoring station 702, a coal pillar internal vertical deformation monitoring station 703 are arranged inside the coal pillar 204, and a roof stress monitoring station 6 is arranged at the roof 4 of the coal pillar 204 between the first working face 202 and the second working face 206, wherein the master computer controls the roof abscission layer monitoring station 8, the overburden strata movement trajectory monitoring station 9, the coal pillar stress monitoring station 701, the coal pillar internal horizontal displacement monitoring station 702, the coal pillar internal vertical deformation monitoring station 703, and the roof stress monitoring station 6 to be in monitoring mode;

Step 2: during the mining period of the first working face 202, the roof abscission layer monitoring station 8 continuously monitors the movement and fracture data of the overburden strata in the goaf of the first working face 202, so as to determine the fracture layer, the length of the fracture block, and the range of the three-zones (caving zone, fractured zone, and sagging subsidence zone) of the overburden strata;

The overburden strata movement trajectory monitoring station 9 continuously monitors the movement trajectory of the overburden strata in the goaf of the first working face, so as to determine the rotation angle and rotational speed of each rock stratum after fracture, and further determine the loading mode of the overburden strata structure movement on the coal pillar 204;

The pillar internal horizontal displacement monitoring station 701 monitors the stress distribution pattern and evolution data of the coal pillar 204, and determines the range of plastic zone and the position of elastic core zone;

The coal pillar internal horizontal displacement monitoring station 702 monitors the horizontal displacement of the coal pillars 204 at different positions, so as to determine the positions and expansion evolution law of internal fractures in the coal pillar 204;

The coal pillar internal vertical deformation monitoring station 703 monitors the compression deformation of the coal pillar at different positions, and determines the range of plastic zone and the position of elastic core zone of the coal pillar 204 in combination of the data of the coal pillar stress monitoring station 701;

The roof stress monitoring station 6 monitors the stress distribution and evolution data of the roof 4, and determines the loading mode of the overburden structure movement on the coal pillar 204 in combination of the data from the overburden movement trajectory monitoring station;

Step 3: after the mining of the first working face 202 is completed, the excavation of the second working face 206 is carried out; during the excavation period of the second working face 206, the roof abscission layer monitoring station 8 continuously monitors the movement and fracture data of the overburden strata in the goaf of the first working face 202, so as to determine the fracture layer, the length of the fracture block, and the range of the three-zones (caving zone zone, fractured zone, and sagging subsidence zone) of the overburden strata;

The overburden strata movement trajectory monitoring station 9 continuously monitors the movement trajectory of the overburden strata in the goaf of the first working face 202, so as to determine the rotation angle and rotational speed of each rock stratum after fracture, and further determine the loading mode of the overburden strata structure movement on the coal pillar 204;

The coal pillar stress monitoring station 701 monitors the stress distribution pattern and evolution data of the coal pillar 204, and determines the range of plastic zone and the position of elastic core zone;

The coal pillar internal horizontal displacement monitoring station 702 monitors the horizontal displacement of the coal pillar 204 at different positions, so as to determine the positions and expansion evolution law of internal fractures in the coal pillar 204;

The coal pillar internal vertical deformation monitoring station 703 monitors the compression deformation of the coal pillar 204 at different positions, and determines the range of plastic zone and the position of elastic core zone of the coal pillar 204 in combination of the data of the coal pillar stress monitoring station 701;

The roof stress monitoring station 6 monitors the stress distribution and evolution data of the roof 4, and determines the loading mode of the overburden structure movement on the coal pillar 204 in combination of the data from the overburden movement trajectory monitoring station;

Step 4: after the excavation of the second working face 206 is completed, the mining of the second working face 206 is carried out; during the mining period of the second working face 206, the roof abscission layer monitoring station 8 continuously monitors the movement and fracture data of the overburden strata in the goaf of the first working face 202, so as to determine the fracture layer, the length of the fracture block, and the range of the three-zones (caving zone, fractured zone, and sagging subsidence zone) of the overburden strata, and to monitor the advance influence range of the overburden strata movement in the goaf of the first working face 202 during the mining period of the second working face 206;

The overburden strata movement trajectory monitoring station 9 continuously monitors the movement trajectory of the overburden strata in the goaf of the first working face 202, so as to determine the rotation angle and rotational speed of each rock stratum after fracture, and further determine the loading mode of the overburden strata structure movement on the coal pillar 204;

The coal pillar stress monitoring station 701 monitors the stress distribution pattern and evolution data of the coal pillar 204, and determines the range of plastic zone and the position of elastic core zone;

The coal pillar internal horizontal displacement monitoring station 702 monitors the horizontal displacement of the coal pillar 204 at different positions, so as to determine the positions and expansion evolution law of internal fractures in the coal pillar 204;

The coal pillar internal vertical deformation monitoring station 703 monitors the compression deformation of the coal pillar 204 at different positions, and determines the range of plastic zone and the position of elastic core zone of the coal pillar 204 in combination of the data of the coal pillar stress monitoring station 701;

The roof stress monitoring station 6 monitors the stress distribution and evolution data of the roof 4, and determines the loading mode of the overburden structure movement on the coal pillar 204 in combination of the data from the overburden movement trajectory monitoring station;

Step 5: based on the data collected from the roof abscission layer monitoring station 8, the overburden strata movement trajectory monitoring station 9, the coal pillar stress monitoring station 701, the coal pillar internal horizontal displacement monitoring station 702, the coal pillar internal vertical deformation monitoring station 703, and the roof stress monitoring station 6 during the first working face 202 mining period, the second working face 206 excavation period, and the second working face 206 mining period, draw the stress distribution curve, the stress deformation evolution curve and the overburden strata movement trajectory of coal pillar 204 at different positions during different working periods, to further determine the influence of the overburden strata movement in the goaf of the first working face 202 on the stress and deformation distribution of the coal pillar 204, and the failure process and failure law of the overburden strata structure movement.

Certainly, the above descriptions are merely preferred embodiments of the present disclosure. The present disclosure is not limited to the above embodiments listed. It should be noted that, all equivalent replacements and obvious variations made by any person skilled in the art under the teaching of the specification fall within the essential scope of the specification and shall be protected by the present disclosure.

What is claimed is:

1. A system for monitoring overlying roof rock and coal pillar of gob-side entry, comprising top monitoring stations, coal pillar comprehensive monitoring stations, roof stress monitoring stations, and a master computer;

a first working face is arranged on a lower coal seam, coal pillars are arranged on a first working face upper roadway, and a plurality of the coal pillar comprehensive monitoring stations on the coal pillars; a second working face is arranged on one side of the first working face on the lower coal seam, and the coal pillars are located between the first working face upper roadway and a second working face lower roadway;

an upper coal seam is located above the lower coal seam, a third working face is arranged on the upper coal seam, a plurality of crossheadings are arranged on the third working face, and a plurality of the top monitoring stations are arranged on the crossheadings;

a plurality of roof stress monitoring stations are arranged at roofs of the coal pillars between the first working face and the second working face on a mining area main roadway;

the master computer is respectively connected to control terminals of the top monitoring stations, the coal pillar comprehensive monitoring stations, and the roof stress monitoring stations through signal cables, during a mining of the first working face, the top monitoring stations, the coal pillar comprehensive monitoring stations, and the roof stress monitoring stations continuously monitor a overlying roof rock and the coal pillars in a goaf of the first working face;

after the mining of the first working face is completed, during an excavation or a mining of the second working face, the top monitoring stations, the coal pillar comprehensive monitoring stations, and the roof stress monitoring stations continuously monitor the overlying roof rock and the coal pillars of the goaf of the first working face.

2. The system for monitoring overlying roof rock and coal pillar of gob-side entry according to claim 1, wherein the top monitoring stations comprise roof abscission layer monitoring stations and overburden strata movement trajectory monitoring stations;

a plurality of the roof abscission layer monitoring stations are arranged on floors of the crossheadings, and each of the roof abscission layer monitoring stations is provided with a multi-point displacement meter; the multi-point displacement meter is arranged from the floor of the crossheading towards the first working face, and a sensor of the multi-point displacement meter is arranged in an immediate roof strata of the first working face;

a plurality of the overburden strata movement trajectory monitoring stations are arranged on the floors of the crossheadings, and each of the overburden strata movement trajectory monitoring stations is provided with a shape acceleration array; the shape acceleration array is arranged from the floor of the crossheading towards the coal pillars between the first working face and the second working face, and a sensor of the shape acceleration array is arranged in the immediate roof strata of the first working face.

3. The system for monitoring overlying roof rock and coal pillar of gob-side entry according to claim 1, wherein the coal pillar comprehensive monitoring stations comprises coal pillar stress monitoring stations, coal pillar internal horizontal displacement monitoring stations, and coal pillar internal vertical deformation monitoring stations;

each of the coal pillar stress monitoring stations is provided with an one-hole multi-point borehole stressmeter, and a sensor of the one-hole multi-point borehole stressmeter is arranged inside the coal pillar;

each of the coal pillar internal horizontal displacement monitoring stations is provided with a multi-point displacement meter, and a sensor of the multi-point displacement meter is arranged inside the coal pillar;

each of the coal pillar internal vertical deformation monitoring stations is provided with a shape acceleration array, and a sensor of the shape acceleration array is arranged inside the coal pillar.

4. The system for monitoring overlying roof rock and coal pillar of gob-side entry according to claim 1, wherein each of the roof stress monitoring stations is provided with one one-hole multi-point borehole stressmeter, the one-hole multi-point borehole stressmeter is arranged from the mining area main roadway to the roof above the coal pillars, and the one-hole multi-point borehole stressmeter is arranged in parallel to a direction of an arrangement of the coal pillars.

5. The system for monitoring overlying roof rock and coal pillar of gob-side entry according to claim 1, wherein a third working face is located diagonally above the first working face, and a length of the third working face is smaller than that of the first working face.

6. The method for monitoring overlying roof rock and coal pillar in gob-side entry, wherein the system for monitoring overlying roof rock and coal pillar of gob-side entry according to claim 1 is applied, and the method comprises the following steps:

step 1, arranging the roof abscission layer monitoring station and the overburden strata movement trajectory monitoring station on the floor of the crossheading, arranging the coal pillar stress monitoring station, the coal pillar internal horizontal displacement monitoring station, and the coal pillar internal vertical deformation monitoring station inside the coal pillar, arranging the roof stress monitoring station at the roof of the coal pillar between the first working face and the second working face, wherein the master computer controls the roof abscission layer monitoring station, the overburden strata movement trajectory monitoring station, the coal pillar stress monitoring station, the coal pillar internal horizontal displacement monitoring station, the coal pillar internal vertical deformation monitoring station, and the roof stress monitoring station to be in monitoring mode;

step 2, during the mining of the first working face, continuously monitoring, by the roof abscission layer monitoring station, a movement and fracture data of an overburden strata in a goaf of the first working face, so as to determine a fracture layer, a length of a fracture block, and a range of three zones of the overburden strata;

monitoring, by the overburden strata movement trajectory monitoring station continuously, a movement trajectory of the overburden strata in the goaf of the first working face, so as to determine a rotation angle and rotational speed of each rock stratum after fracture, and further determining a loading mode of an overburden strata structure movement on the coal pillar;

monitoring, by the coal pillar stress monitoring station, a stress distribution pattern and evolution data of the coal pillar, and determining a range of plastic zone and a position of elastic core zone;

monitoring, by the coal pillar internal horizontal displacement monitoring station, an horizontal displacement of the coal pillar at different positions, so as to determine positions and expansion evolution law of internal fractures in the coal pillar;

monitoring, by the coal pillar internal vertical deformation monitoring station, a compression deformation of the coal pillar at different positions, and determining a range of the plastic zone and a position of the elastic core zone of the coal pillar in combination of data of the coal pillar stress monitoring station;

monitoring, by the roof stress monitoring station, a stress distribution and evolution data of the roof, and determining a loading mode of the overburden structure movement on the coal pillar in combination of data from the overburden movement trajectory monitoring station;

step 3, conducting an excavation of the second working face after the mining of the first working face is completed; continuously monitoring, by the roof abscission layer monitoring station, the movement and fracture data of the overburden strata in the goaf of the first working face during the excavation of the second working face, so as to determine the fracture layer, the length of the fracture block, and the range of the three-zones of the overburden strata;

continuously monitoring, by the overburden strata movement trajectory monitoring station, the movement trajectory of the overburden strata in the goaf of the first working face, so as to determine the rotation angle and rotational speed of each rock stratum after fracture, and further determining the loading mode of the overburden strata structure movement on the coal pillar;

monitoring, by the coal pillar stress monitoring station, the stress distribution pattern and evolution data of the coal pillar, and determining the range of plastic zone and the position of elastic core zone;

monitoring, by the coal pillar internal horizontal displacement monitoring station, the horizontal displacement of the coal pillar at different positions, so as to determine the positions and expansion evolution law of internal fractures in the coal pillar;

monitoring, by the coal pillar internal vertical deformation monitoring station, the compression deformation of the coal pillar at different positions, and determining the range of plastic zone and the position of elastic core zone of the coal pillar in combination of the data of the coal pillar stress monitoring station;

monitoring, by the roof stress monitoring station, the stress distribution and evolution data of the roof, and determining the loading mode of the overburden structure movement on the coal pillar in combination of the data from the overburden movement trajectory monitoring station;

step 4, conducting the mining of the second working face after the excavation of the second working face is completed; continuously monitoring, by the roof abscission layer monitoring station, the movement and fracture data of the overburden strata in the goaf of the first working face during the mining of the second working face, so as to determine the fracture layer, the length of the fracture block, and the range of the three-zones of the overburden strata, and monitoring an advance influence range of the overburden strata movement in the goaf of the first working face during the mining of the second working face;

continuously monitoring, by the overburden strata movement trajectory monitoring station, the movement trajectory of the overburden strata in the goaf of the first working face, so as to determine the rotation angle and rotational speed of each rock stratum after fracture, and further determining the loading mode of the overburden strata structure movement on the coal pillar;

monitoring, by the coal pillar stress monitoring station, the stress distribution pattern and evolution data of the coal pillar, and determining the range of plastic zone and the position of elastic core zone;

monitoring, by the coal pillar internal horizontal displacement monitoring station, the horizontal displacement of the coal pillar at different positions, so as to determine the positions and expansion evolution law of internal fractures in the coal pillar;

monitoring, by the coal pillar internal vertical deformation monitoring station, the compression deformation of the coal pillar at different positions, and determining the range of plastic zone and the position of elastic core zone of the coal pillar in combination of the data of the coal pillar stress monitoring station;

monitoring, by the roof stress monitoring station, the stress distribution and evolution data of the roof, and determining the loading mode of the overburden structure movement on the coal pillar in combination of the data from the overburden movement trajectory monitoring station;

step 5, drawing a stress distribution curve, a stress deformation evolution curve and an overburden strata movement trajectory of coal pillar at different positions during different working periods based on the data collected from the roof abscission layer monitoring station, the overburden strata movement trajectory monitoring station, the coal pillar stress monitoring station, the coal pillar internal horizontal displacement monitoring station, the coal pillar internal vertical deformation monitoring station, and the roof stress monitoring station during the mining of the first working face, the excavation of the second working face, and the mining of the second working face, so as to further determine the influence of the overburden strata movement in the goaf of the first working face on the stress and deformation distribution of the coal pillar, and a failure process of the overburden strata structure movement.

* * * * *